United States Patent [19]

Guezou et al.

[11] Patent Number: 4,929,200

[45] Date of Patent: May 29, 1990

[54] VESSEL PROVIDED WITH AT LEAST ONE WATER JET PROPULSION UNIT

[75] Inventors: Jean-Pierre Guezou, Athis-Mons; Jacques Pichard, Meudon, both of France

[73] Assignee: L'Etat Francais, France

[21] Appl. No.: 272,013

[22] Filed: Nov. 16, 1988

[30] Foreign Application Priority Data

Nov. 16, 1987 [FR] France ..... 87 15782

[51] Int. Cl.[5] ..... B63H 11/00

[52] U.S. Cl. ..... 440/38; 440/47; 416/93 A

[58] Field of Search ..... 440/38–44, 440/46, 47, 67, 66; 60/221, 222; 416/93 A; 114/67 A; 239/265.19, 265.23, 265.37

[56] References Cited

U.S. PATENT DOCUMENTS 3,214,903 11/1965 Cochran ..... 440/47
3,249,083 5/1966 Irgens ..... 416/93 A
4,631,032 12/1986 Nishida ..... 416/93 A

FOREIGN PATENT DOCUMENTS 169974 8/1904 Fed. Rep. of Germany .
2212650 9/1973 Fed. Rep. of Germany ..... 440/38
2031627 11/1970 France .
2171351 9/1973 France .
2228661 12/1974 France .
1271870 4/1972 United Kingdom .
1323872 7/1973 United Kingdom ..... 440/38

*Primary Examiner*—Sherman D. Basinger
*Assistant Examiner*—Jesûs D. Sotelo
*Attorney, Agent, or Firm*—Oliff & Berridge

[57] ABSTRACT

Vessel provided with at least one water jet propulsion unit consisting of a casing containing, between an intake (3) tangential to the hull (2) and a rear water outlet (4), a duct (5) upstream of the propulsion device, an impeller (6), fixed flow-correction guide vanes (7) and a tail cone (8) carried by the blades which with the casing (9) form the tail pipe (10). The cross section of the tail pipe (10) varies but within narrow limits between the vanes (7) and the outlet (4) by virtue of a number of gas injection slots situated in the area of the trailing edges of the vanes (7) and connected by a circuit to a supply of compressed gas (16). The gas supply circuit includes an external annular chamber (14) formed within the casing and the shroud surrounding the vanes (7) and connected to the injection slots (25, 26, 29). Of application to vessels requiring very high thrusts.

10 Claims, 3 Drawing Sheets

VESSEL PROVIDED WITH AT LEAST ONE WATER JET PROPULSION UNIT

The invention relates to a vessel provided with at least one water jet propulsion unit consisting of a casing containing, between a water intake tangential to the hull and a rear water outlet, an upstream duct, an axial impeller, fixed flow-correction guide vanes and a tail cone carried on the vanes which together with the casing, forms the tail pipe. In propulsion units of this type, it is known that the impeller provides the necessary pressure to bring up to speed the water flow which is then accelerated by the convergence of the outlet pipe. But this pressure, applied to the converging walls of the tail pipe results in internal drage forces which lessen the thrust of the unit.

The invention has as its aim the elimination of this defect and, to do this, the cross section of the tail pipe varies within narrow limits and, advantageously, is made constant between the vanes and the outlet by virtue of gas injector nozzles being placed in the tail pipe, the gas being most frequently compressed air, and the nozzles being sited in the area of the rear edge of the vanes and connected by an air circuit to a means of supply of compressed gas.

One can see that as a consequence of the tail pipe being no longer convergent, the internal drag is eliminated, to the benefit of the thrust of the propulsion unit, whilst the acceleration of the water is ensured by the greater volume of the gas-water mixture.

In accordance with a preferred embodiment of the invention, the gas supply circuit comprises an outer annular chamber formed in the casing, around the shrouded vanes and connected to the slot-shaped discharge nozzles.

This arrangement ensures the uniformity of gas pressure around the vanes and a certain degree of pressure regulation. This outer annulus discharges connects directly with the injection nozzles which consist of an annular slot between the rear edge of the vane shroud and the causing.

The outer annulus may also be connected via passages formed within the vanes to an inner annular chamber situated between the tail cone and the base of the vanes and discharging through an annular slot at inner rear edge of the vanes. Finally, it may be connected via passages formed in the vanes to nozzles consisting on this occasion of slots running along the rear edges of the vanes.

These various arrangements may naturally be combined, either in pairs or all three may made be used simultaneously.

They offer the advantage of ensuring an excellent diffusion of the gas in the water and therefore, of avoiding any disturbance of the flow which could give rise to vibrations or other functional irregularities.

In accordance with another refinement coming within the scope of the invention, a means is provided of varying the degree of convergence of the outlet pipe. In fact, the consumption of the extra energy needed to compress and inject the gas may not always be justified and it is therefore useful to be able to convert the tail pipe into a conventional tapered one so that the unit may be run without gas injection.

A number of versions of embodiments of the invention are now described by way of non-restrictive examples and with reference to the attached drawings in which.

Figure 1:
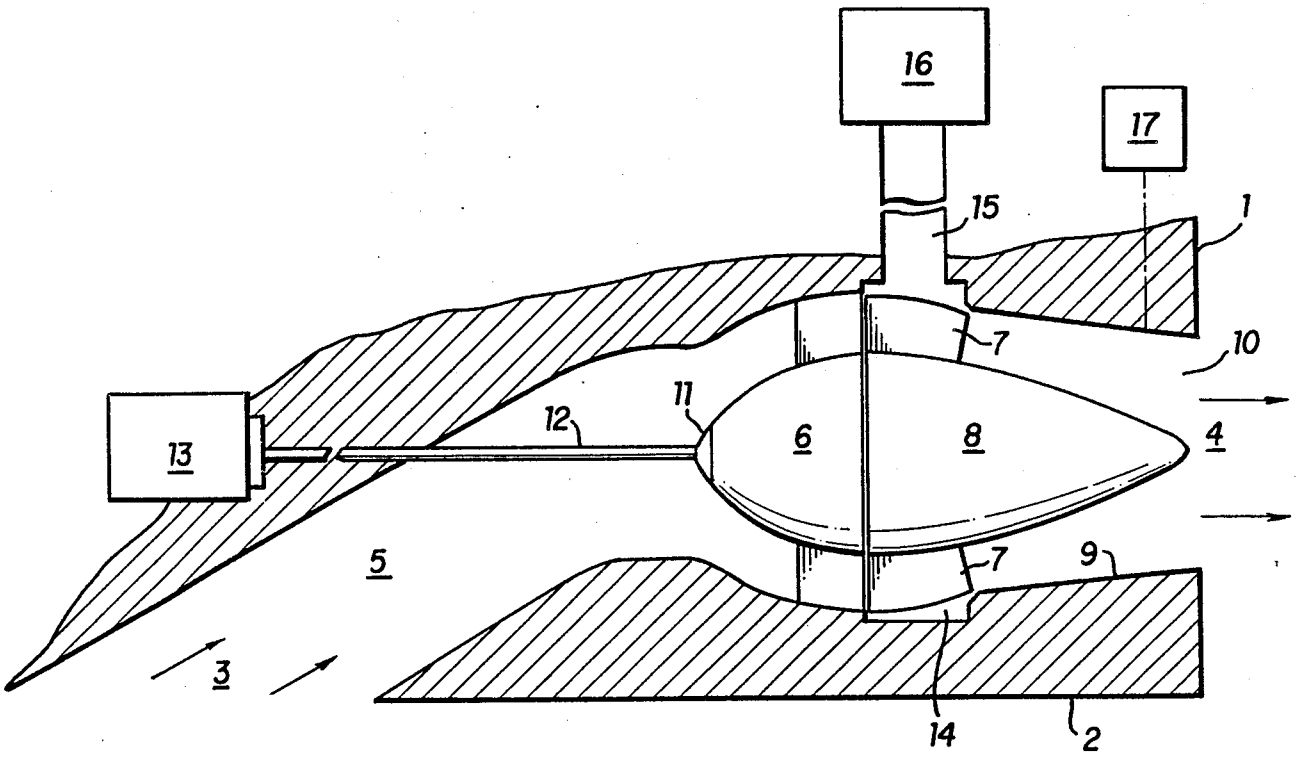
FIG. 1 is a part cross-sectioinal representation of the stern of a vessel in conformity with the invention.

In FIG. 1 may be seen the stern 1 of a vessel and the adjacent longitudinal portion of the hull 2, between which is fitted one of the two propulsion units, a propulsion unit comprising, between an inlet 3 tangential to the chord of the hull and a rear outlet 4, a duct 5, upstream of the impeller 6, fixed flow-correction guide vanes 7, which support a tail cone 6 which, with the rear part of casing 9, form the tail pipe 10.

The rotating hub 11 of the impeller is connected via a shaft 12 to the engine 13.

Figure 2:
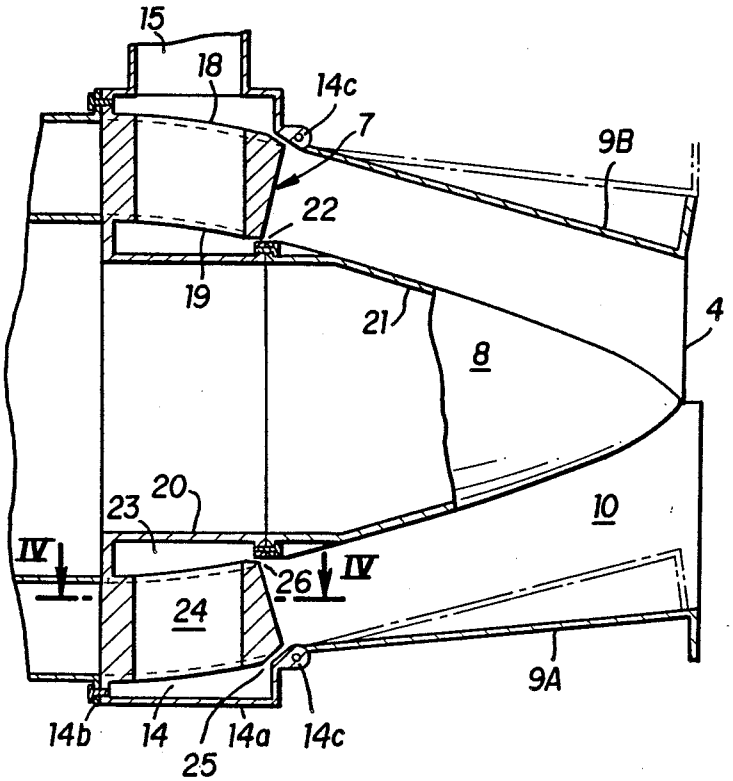
FIG. 2 is a larger scale cross section of the rear part of one of the propulsion units of this vessel.

At the level of the vanes 7, the casing forms an annular chamber 14 fed from a compressor 16 via a duct 15. Finally there is shown diagramatically a mechanism of known type 17 connected to a portion of the casing 9 so as to vary its convergence and therefore the convergence of the pipe 10. FIG. 2 represents in greater detail the outer annulus 14 constituted by the outer annular casing **14*a* connected to the main propulsion unit casing at the front at 14*b* and at the rear at 14*c*. The inner wall of the annular chamber is constituted by the outer shroud 18 fixed to the vanes 7, as is the inner vane ring 19**.

Figure 3:
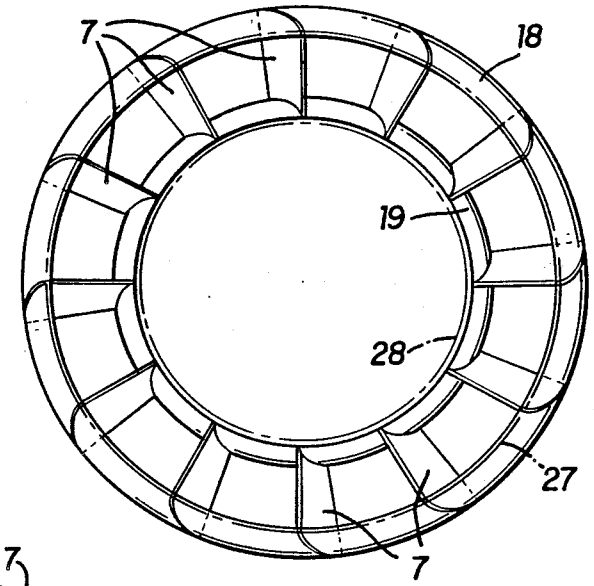
FIG. 3 is a view from the stern showing the structure of the vanes of the propulsion unit.

The outer and inner rings 18 and 19, as well as the vanes 7, are pierced with channels 24 which (therefore) connect the ouer annular chamber 14 with the inner annular chamber 23. The outer annular chamber 14 and the trailing edges of the vanes and the inner ring 18 are separated by an annular slot 25 which discharges, at low angle of incidence, into the outlet pipe 10. In the same fashion, the trailing edges of the vanes and the shroud ring 19 are separated from the rear wall of the inner annular chamber 23 by an annular slot 26 which discharges at a low angle of incidence into the outlet pipe 10. To illustrate clearly these two annular slot-shaped nozzles 25 and 26 in FIG. 3 the rear edges 27 and 28 of, respectively, the outer annulus and the inner annulus are shown in broken lines.

It wil be noted that at the foot of FIG. 2 the casing 9 has been shown in the position 9A, such that the cross sectional area of the outlet pipe is constant, from the vanes to the outlet 4. In other words, the area of the annulus described at the rear of the vanes by the tail cone 8 and the casing 9A is the same, or approximately the same, as the cross sectional area of the outlet 4. As opposed to this, the corresponding portion of the casing 9 shown in the upper part of FIG. 2 shows it in the position 9B, traditional for propulsion units of this type, where it is markedly more convergent, so that the cross sectional area of the outlet 4 is much less than that of the annular section at the rear of the vanes. The transition from one configuration to the other is achieved by the mechanism 17 in accordance with known methods.

Figure 6:
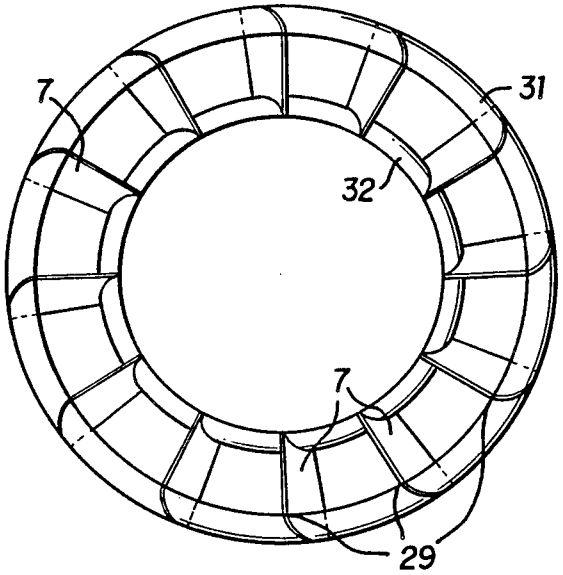
FIG. 6 is a view from the stern showing the structure of the vanes of this propulsion unit.
Figure 7:
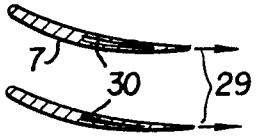
FIG. 7 represents two adjacent vanes of this same propulsion unit in cross section in a cylindrical plane materialised by the line VII—VII of FIG. 5.
Figure 5:
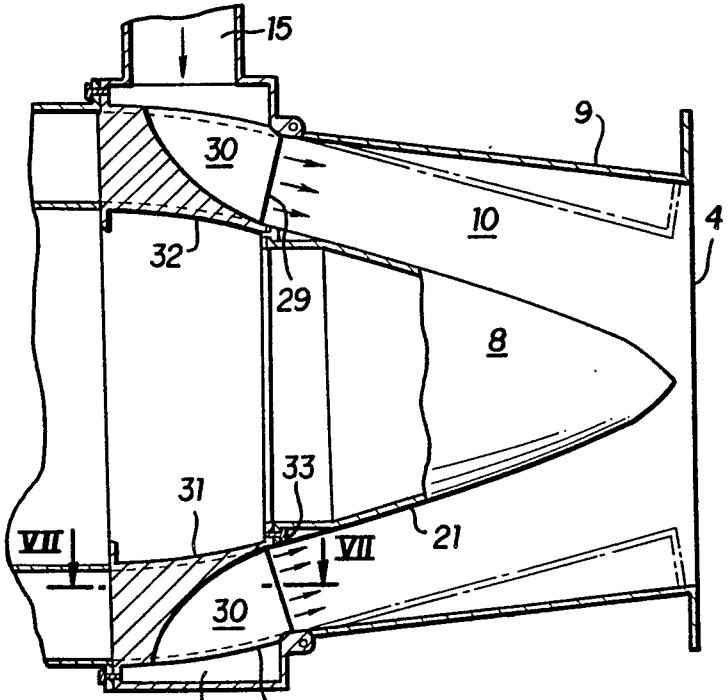
FIG. 5 is a cross section at the same scale of the rear part in another embodiment of the propulsion unit.

FIGS. 5, 6 and 7 represent another means of embodiment of the invention in which the vanes present along their trailing edges rectangular nozzles taking the form of slots allowing air to be injected parallel to the flow of water passing through the openings between the vanes. These slots 29 are connected to the outer annular chamber 14 by the channels 30 provided in each vane and in the outer shroud ring 31, which take the form of curved ducts of virtually constant cross sectional area. In this embodiment, the inner ring 32 which has no holes in it, is attached directly at 33 to the shell 21 of the tail cone 8.

It is known that for vessels of this type, the propulsive thrust is traditionally obtained by accelerating the water in the outlet pipe 10 while the casing is in position 9B, the outelt pipe then being a tapered one.

But the internal drag resultig from the pressure exercised by the water against this casing 9B reduces correspondingly the propulsive thrust.

If the user of the vessel wishes to benefit from higher thrust, he must act in such a way, via the mechanism 17, that the tail pipe casing is moed from position 9B to position 9A, so that the drag is eliminated.

On the other hand, the cross sectional area of the pipe increases towards the outlet to an extent represented in FIGS. 2 and 5 by the triangular area above the broken line drawn in the vicinity of the casing 9A and it is therefore necessary to start up the compressor 16 whose role it is to compensate for this increase in volume of the tail pipe by injecting air into it at the level of the vanes, air whose pressure will be progressively reduced as it passes along the tail pipe 10 until it reaches atmospheric pressure at the outlet 4, and whose volume will therefore increase inversely.

Trials carried out by the applicant have shown that the injection of a volume of air equal, at atmospheric pressure, to that of the water, produces a relative increase in thrust of over 50% as compared with that obtained with the casing in position 9B and with no air injection. It is even possible to obtain a thrust increase of 75% by injecting even larger quantities of air, up to three times the volume of the water, again, considered at atmospheric pressure.

It is accepted that for high performance vessels; for which the power output is not a decisive factor, may not incorporate mechanisms of the type of 17, but have the casing 9 permanently in the position 9B.

On the other hand, as is more often the case, bursts of power of 50 to 75% of above the maximum rated thrust are often required to meet exceptional circumstances, in particular when the vessel is required to plane, a mode which upsets its normal functioning, and for those sudden accelerations which, from time to time, may be valuable.

Figure 4:
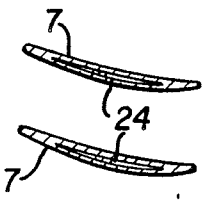
FIG. 4 represents a cross section through two adjacent vanes along the line IV—IV of FIG. 2.

This is why it has seemed advantageous to use air injection in accordance with the invention only for comparatively short periods of time, since owing to the energy used by the compressor, it represents a lowering of overall performance. AS regards the modes of embodiment of the invention, it should be noted that injection from the outer annulus, described in FIG. 2, could, in principle and especially for small craft, be used on its own, in which case, the channels 24, the inner annular chamber 23 and the slot 26 are no longer required. Theoretically, injection via the inner annulus and the slot 26 could equally well be used on its own, in which case the slot 25 may be dispensed with. Finally, either one of the two methods, injection from the outer annulus, or from the inner one, or from both, may be used in combination with injection via the slots 29, since to do this it suffices to connect the slots 29 in FIGS. 5 to 7 with the channels 24 in FIGS. 2 to 4.

We claim:

1. A vessel provided with at least one water jet propulsion unit comprising a water intake and a rear outlet for the water, an axial impeller, flow-correction guide vanes and a tail cone carried on the vanes which, together with a surrounding casing from the tail pipe, wherein the cross sectional area of water flow through the tail pipe is varied within arrow narrow limits between the vanes and the outlet by a volume of gas introduced in the tail pipe by means comprising a gas injection nozzle placed in the area of the vanes the nozzle being connected to a means of supply of compressed gas comprising an outer annular chamber formed within the casing and around the circumference of the vanes.

2. A vessel according to claim 1, wherein the structural cross sectional area of the tail pipe is constant.

3. A vessel according to claim 1, wherein the gas is air.

4. A vessel according to claim 1, wherein the outer annular chamber discharges directly into an injection nozzle formed by an annular passage between the casing and the trailing edge of the vanes.

5. A vessel according to claim 4, wherein the injection nozzle further comprises a second annular passage positioned between the tail cone and the trailing edge of the vanes, the second annular passage being in fluid communication with the other annular chamber via channels provided within the vanes and an inner annular chamber formed within the tail cone at the level of the vanes.

6. A vessel according to claim 1, wherein the injection nozzle comprises a slot running along the trailing edge of each of the vanes connected via channels formed within the vanes to the outer annular chamber.

7. A vessel according to claim 1, wherein a means is provided to vary the degree of convergence of the tail pipe structurally.

8. A vessel according to claim 1, wherein said means of supply of compressed gas comprises an air supply circuit.

9. A vessel provided with at least one water jet propulsion unit comprisiing a water intake at a tangent to the hull and a rear outlet for the water, an axial impeller, flow-correction guide vanes and a tail cone carried on the vanes which, together with a surrounding casing from the tail pipe, wherein the cross section area of water flow through the tail pipe is varied within narrow limits between the vanes and the outlet by a volume of gas introduced in the tail pipe by means comprising gas injection nozzle placed in the area of the vanes and connected to a means of supply of compressed gas.

10. A vessel according to claim 9, wherein said water intake further comprises an upstream duct.

* * * * *